United States Patent [19]

Stansbury

[11] Patent Number: 5,071,147

[45] Date of Patent: Dec. 10, 1991

[54] DEVICE FOR PROTECTIVELY STORING AND TRANSPORTING GOLF EQUIPMENT

[76] Inventor: Dan Stansbury, 47-477 Kalanianaole Hwy., Waimanalo, Hi. 96795

[21] Appl. No.: 564,453

[22] Filed: Aug. 8, 1990

[51] Int. Cl.[5] ..... B62B 1/10

[52] U.S. Cl. ..... 280/47.19; 280/47.26; 280/DIG. 6; 206/315.2; 206/315.6

[58] Field of Search ..... 280/47.19, 47.26, 47.24, 280/DIG. 6, 47.27, DIG. 5, 79.2, 651, 652; 206/315, 315.1, 315.2, 315.3, 315.4, 315.5, 315.6, 315.8; D34/15

[56] References Cited

U.S. PATENT DOCUMENTS 4,726,597 2/1988 Hickin ..... 280/DIG. 6

4,890,856 1/1990 Mursch et al. ..... 280/DIG. 6

4,905,827 3/1990 Kim ..... 280/DIG. 6

*Primary Examiner*—Andres Kashnikow

*Assistant Examiner*—Richard Camby

*Attorney, Agent, or Firm*—Michael I. Kroll

[57] ABSTRACT

A device for protectively storing and transporting golf equipment is provided and consists of an upper angled cushioning insert carried within the forwardly angled open top end of an elongated rigid housing and a plurality of separators spaced apart and angularly positioned vertically within the housing to form vertically angled channels therein. A lid is hinged to the open top end of the housing to protect the heads of golf clubs which are invertably inserted through apertures in the upper angled cushioning insert and through the channels whereby the golf clubs are protected from making contact with each other.

4 Claims, 2 Drawing Sheets

10
12
14
16
18
20
22
26
28
34
36
38
40
42
44
46
52
56
58
60
3

Fig. 3
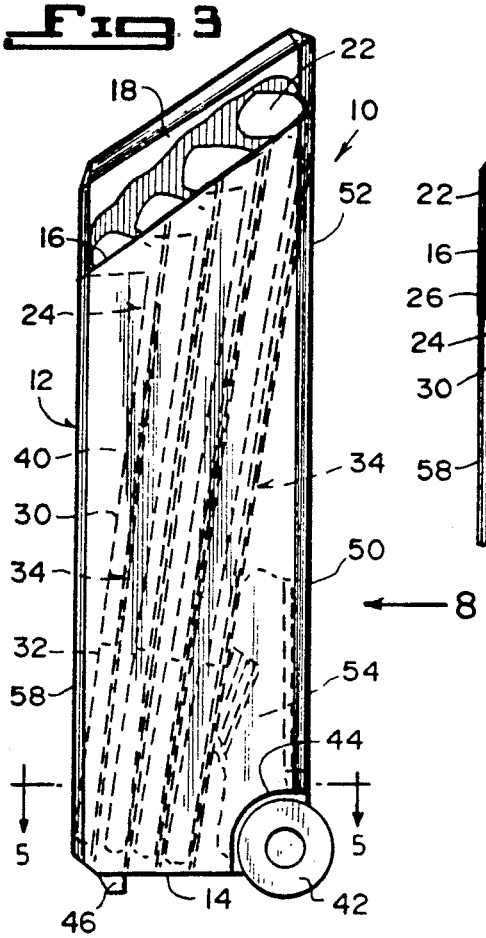
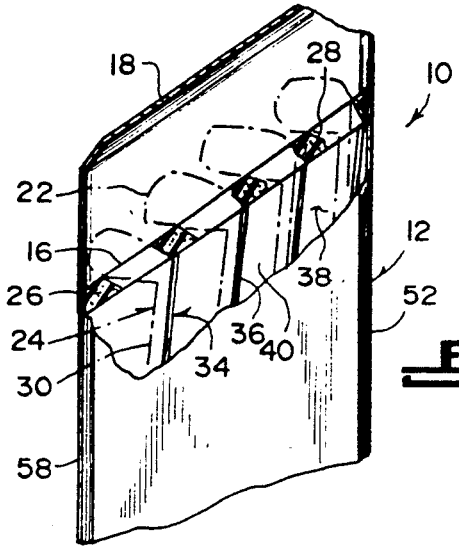
Fig. 4
Fig. 5
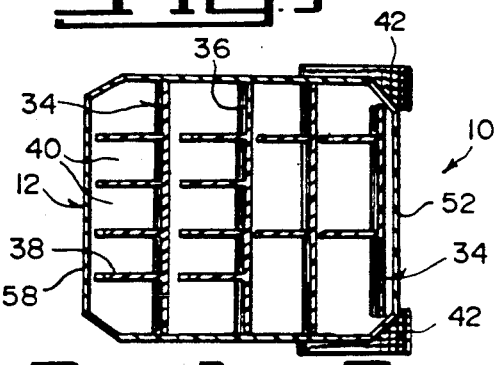
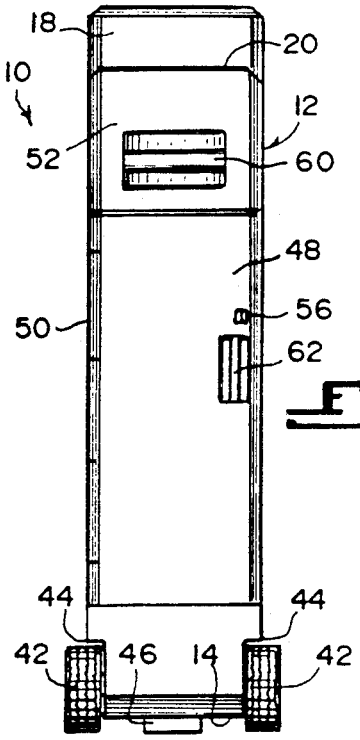
Fig. 8
Fig. 6
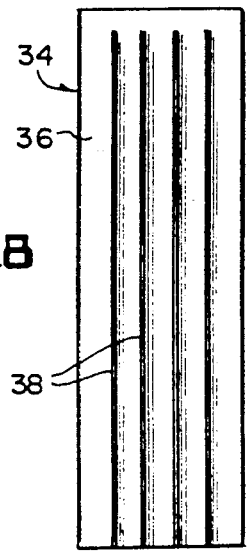
Fig. 7
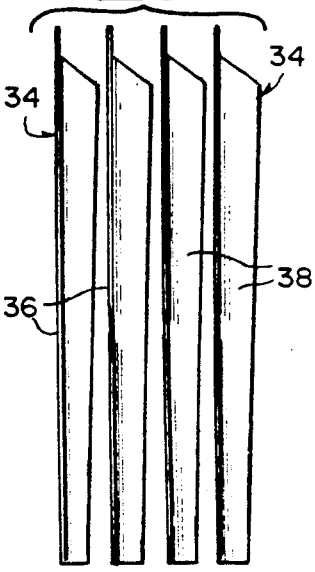

DEVICE FOR PROTECTIVELY STORING AND TRANSPORTING GOLF EQUIPMENT

BACKGROUND OF THE INVENTION

1. Field of the Invention

The instant invention relates generally to golf bags and more specifically it relates to a device for protectively storing and transporting golf equipment.

2. Description of the Prior Art

Numerous golf bags have been provided in prior art that are adapted to carry a set of golf clubs and accessories as required. While these units may be suitable for the particular purpose to which they address, they would not be as suitable for the purposes of the present invention as heretofore described.

SUMMARY OF THE INVENTION

A primary object of the present invention is to provide a device for protectively storing and transporting golf equipment that will overcome the shortcomings of the prior art devices.

Another object is to provide a device for protectively storing and transporting golf equipment that would be locked-in so as to be less likely to be damaged during the playing of the game and when being transported.

An additional object is to provide a device for protectively storing and transporting golf equipment in which internal separation of golf clubs will protect the clubheads and shafts from continuous contact with each other.

A further object is to provide a device for protectively storing and transporting golf equipment that is simple and easy to use.

A still further object is to provide a device for protectively storing and transporting golf equipment that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

FIG. 3 is a side view taken in the direction of arrow 3 in FIG. 1, with parts broken away.

FIG. 4 is a side view of the upper portion of the device with parts broken away showing the upper angled insert therein.

FIG. 5 is a cross sectional view taken along line 5—5 in FIG. 3.

FIG. 6 is a front view of one of the lower angled separating inserts.

FIG. 7 is a side view of all of the lower angled separating inserts.

FIG. 8 is rear view of the invention taken in the direction of arrow 8 in FIG. 3.

DETAILED DESCRIPTION OF THE PREFERRED EMBODIMENTS

Figures 1, 2:
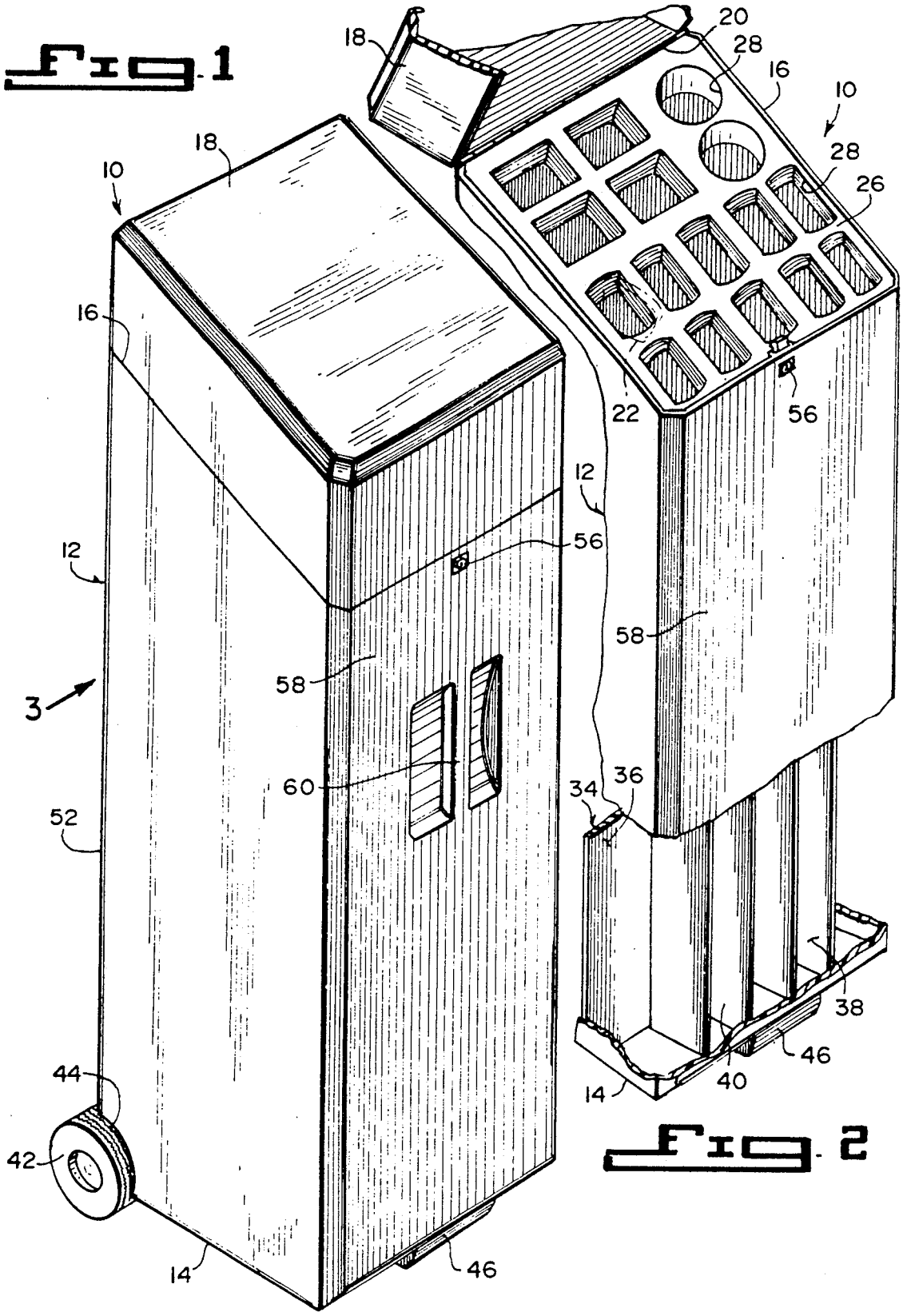
FIG. 1 is a front perspective view of the instant invention showing the top protective cover closed.
FIG. 2 is a front perspective view with parts broken away showing the top protective cover open.

Turning now descriptively to the drawings, in which similar reference characters denote similar elements throughout the several views, the Figures illustrate a device 10 for protectively storing and transporting golf equipment and consists of an elongated rigid housing 12 having a closed flat bottom end 14 and a forwardly angled opened top end 16. A lid 18 is hinged at 20 to the higher rearward edge of the opened top end 16 of the housing 12 to cover and protect the heads 22 of golf clubs 24 which are invertably inserted within the housing 12 and other golf equipment, such as balls, tees, etc.

An upper angled cushioning inset 26, such as rubber or the like, has a plurality of apertures 28 therethrough and is carried within the forwardly angled opened top end 16 of the housing 12. The heads 22 of the golf clubs 24 can rest naturally in place in some of the apertures 28, free from contact with each other, while shafts 30 and handles 32 of the golf clubs 24 are suspended above the bottom end 14 of the housing 12, whereby some of the other apertures 28 can hold other golf equipment therein.

A plurality of separators 34 are provided, with each having a back partition 36 and plurality of tapered side partitions 38 extending outwardly from the back partition 36. The separators 34 are spaced apart and angularly positioned vertically within the housing 12 so that the top edges of the back partitions 36 of the separators 34 are tilted backwards with respect to the bottom edges of the back partitions 36 of the separators 34. The tapered side partitions 38 divides the interior of the housing 12 into a plurality of vertically angled channels 40 which line up with the apertures 28 in the upper angled cushioning insert 26. The shafts 30 and handles 32 of the golf clubs 24 are protected within the channels 40 from making contact with each other.

The device 10 further includes a pair of wheels 42, each recessed on an opposite rear corner 44 of the bottom end 14 of the housing 12 for mobility of the housing 12. A small foot 46 is affixed to the bottom end 14 of the housing 12 opposite from the wheels 42 to provide stability to the housing, when the housing 12 stands upright unattended.

A door 48 is formed into and hinged at 50 onto the back wall 52 of the housing 12 so as to have access to a rear storage compartment 54, for related golf equipment, behind the last of the separators 34. A pair of release mechanisms 56 are also provided. One release mechanism 56 is located in the front wall 58 of the housing adjacent the lid 18. The other release mechanism 56 is located in the door 48 so that when manually activated, the release mechanism 56 will allow the lid 18 and the door 48 to open.

The device 10 further includes a pair of recessed handles 60. On handle 60 is located horizontally above the door 48 in the back wall 54 of the housing 12. The other handle 60 is located vertically in the front wall 58 of the housing 12 so that a person can grip the handles 60 to transport the device 10. Another recessed handle 62 is located vertically in the door 48 so that the door can be easily opened.

The housing 12, lid 18 and separators 34 can all be fabricated out of a durable waterproof plastic material or any other type of strong lightweight substance, such as metal, wood, etc.

LIST OF REFERENCE NUMBERS

10: device
12: elongated rigid housing
14: closed flat bottom end in 12
16: forwardly downwardly angled opened top end in 12
18: lid
20: hinge for 18
22: head of 24
24: golf club
26: upper angled cushioning insert
28: apertures in 26
30: shaft of 24
32: handle of 24
34: separator
36: back partition in 34
38: tapered side partition in 34
40: channel in 12
42: wheel
44: recessed rear corner of 14
46: small foot
48: door
50: hinge for 48
52: back wall of 12
54: rear storage compartment in 12
56: release mechanism
58: front wall of 12
60: recessed handle in 52 and 58
62: recessed handle in 48.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A device for protectively storing and transporting golf equipment, comprising:

a) an elongated rigid housing having a closed flat bottom end and a forwardly angled opened top end;

b) a lid hinged to the higher rearward edge of said opened top end of said housing to cover and protect the heads of golf clubs which are invertably inserted within said housing and other golf equipment;

c) an upper angled cushioning insert having a plurality of apertures therethrough, said upper angled cushioning insert carried within said forwardly angled opened top end of said housing so that the heads of the golf clubs can rest naturally in place in some of the apertures, free from contact with each other while shafts and handles of the golf clubs are suspended above said bottom end of said housing whereby some other apertures can hold other golf equipment therein;

d) a plurality of separators, each having a back partition and a plurality of tapered side partitions extending outwardly from the back partition, said separators are spaced apart and angularly positioned vertically within said housing so that the top edges of the back partitions of said separators are tilted backwards with respect to the bottom edges of said back partitions of said separators while said tapered side partitions divide the interior of said housing into a plurality of vertically angled channels which line up with said apertures in said upper angled cushioning insert whereby the shafts and handles of the golf clubs are protected within the channels from making contact with each other; e) a pair of wheels, each recessed and mounted directly on an opposite rear corner of said bottom end of said housing for mobility of said housing; and f) a small non piercing foot affixed to said bottom end of said housing opposite from said wheels to provided stability to said housing when said housing stands upright unattended without having to pierce the ground so that rot and mildew is eliminated.

2. A device as recited in claim 1; further comprising a door formed into and hinged onto the back wall of said housing so as to have access to a rear storage compartment for related golf equipment, behind the last of said separators.

3. A device as recited in claim 2; further comprising a pair of release mechanisms, one said release mechanism located in the front wall of said housing adjacent said lid and the other said release mechanism located in said door so that when manually activated said release mechanisms will allow said lid and said door to open.

4. A device as recited in claim 3; further comprising a pair of recessed handles, one said handle located horizontally above said door in said back wall of said housing and the other said handle located vertically in said front wall of said housing so that a person can grip said handles to transport said device.

* * * * *